US006113209A

United States Patent [19]

Nitta et al.

[11] Patent Number: 6,113,209

[45] Date of Patent: Sep. 5, 2000

[54] DRIVING DEVICE FOR ELECTROSTRICTIVE INK-JET PRINTER HEAD HAVING CONTROL CIRCUIT WITH SWITCHING ELEMENTS FOR SETTING ELECTRICAL POTENTIAL RANGES OF POWER SUPPLY TO ELECTRODES OF THE PRINTER HEAD

[75] Inventors: Noboru Nitta; Shunichi Ono; Jun Takamura, all of Shizuoka-ken, Japan

[73] Assignee: Toshiba Tec Kabushiki Kaisha, Tokyo, Japan

[21] Appl. No.: 08/763,232

[22] Filed: Dec. 10, 1996

[30] Foreign Application Priority Data

| | | | |
|---|---|---|---|
| Dec. 14, 1995 | [JP] | Japan | 7-325751 |
| Sep. 19, 1996 | [JP] | Japan | 8-248256 |
| Nov. 6, 1996 | [JP] | Japan | 8-293550 |

[51] Int. Cl.[7] ..... B41J 29/38

[52] U.S. Cl. ..... 347/9; 347/10

[58] Field of Search ..... 347/9, 10, 11, 347/68–72, 12

[56] References Cited

U.S. PATENT DOCUMENTS 5,028,812 7/1991 Bartky .

FOREIGN PATENT DOCUMENTS

0341929 A2 11/1989 European Pat. Off. .

0 634 272 A2 1/1995 European Pat. Off. .

05-016361 1/1993 Japan .

OTHER PUBLICATIONS

Patent Abstracts of Japan, vol. 017, No. 286 (M–1422), Jun. 2, 1993 & JP 05–016361 (Fuji Electric Co. Ltd.), Jan. 26, 1993,—Abstract.

*Primary Examiner*—John Barlow
*Assistant Examiner*—C. Dickens
*Attorney, Agent, or Firm*—Frishauf, Holtz, Goodman, Langer & Chick, P.C.

[57] ABSTRACT

A head driving device has first MOS field effect transistors connected between a VDD power supply terminal and electrodes, and second MOS field effect transistors connected between a VSS power supply terminal and the electrodes. In the driving device, ink is ejected from each ink chamber due to the variation in pressure which is caused by charging and discharging of corresponding capacitances each across an electrode of the predetermined ink chamber and electrodes of ink chambers adjacent to the predetermined ink chambers. Both of the first MOS field effect transistors and second MOS field effect transistors are formed on one semiconductor substrate. T the potential of the semiconductor substrate is set to be out of a range between the potentials of the VDD and VSS power supply terminals.

9 Claims, 9 Drawing Sheets

DRIVING DEVICE FOR ELECTROSTRICTIVE INK-JET PRINTER HEAD HAVING CONTROL CIRCUIT WITH SWITCHING ELEMENTS FOR SETTING ELECTRICAL POTENTIAL RANGES OF POWER SUPPLY TO ELECTRODES OF THE PRINTER HEAD

BACKGROUND OF THE INVENTION

The present invention relates to a head driving device for an ink-jet printer having an ink-jet head which utilizes electrostrictive elements for causing variations in pressure in ink chambers by electrostriction thereof.

The head of an ink-jet printer of this type has, e.g., an arrangement shown in FIG. 8. More specifically, a plurality of recessed grooves are formed in a piezoelectric member 1 at predetermined pitches, and an upper lid 2 is fixed on the grooves to form ink chambers 3 in association with the grooves. An electrode 4 is spread over the bottom portion and side walls of each ink chamber 3. A nozzle (not shown) is formed in front of each ink chamber 3, and an ink supply port (not shown) is formed in the rear of each ink chamber 3. In this head, the piezoelectric member 1 has portions forming walls for partitioning the ink chambers 3 from each other and serving as piezoelectric elements 5 interposed between electrodes 4. For this reason, adjacent two of the electrodes 4 constitutes a capacitance along with the piezoelectric element 5 located therebetween. Accordingly, the equivalent circuit of this head may be expressed by a series circuit of capacitors connected to each other via the electrodes 4.

A head driving device for driving such a head is disclosed in Japanese Unexamined Patent Publication No. 2-18054. For example, as shown in FIG. 9, the equivalent circuit of the head is a series circuit of capacitances CL1, CL2, CL3, CL4, - - - connected in series and constituted by piezoelectric elements 5 and electrodes a, b, c, d, e, - - - . For this circuit, p-channel MOS field effect transistors Q11, Q12, Q13, Q14, Q15, - - - are connected between a VDD power supply terminal and the electrodes a, b, c, d, e, - - - , and n-channel MOS field effect transistors Q21, Q22, Q23, Q24, Q25, - - - are connected between a ground line and the electrodes a, b, c, d, e, - - - .

Diodes D1, D2, D3, D4, D5, - - - are connected in parallel with the n-channel MOS field effect transistors Q21, Q22, Q23, Q24, Q25, - - - to have reversed polarity. The back gates of the p-channel MOS field effect transistors Q11, Q12, Q13, Q14, Q15, - - - are connected to the VDD power supply terminal, and the back gates of the n-channel MOS field effect transistors Q21, Q22, Q23, Q24, Q25, - - - are connected to the ground line. Drive signals are supplied to the gate terminals of the field effect transistors Q11, Q12, Q13, Q14, Q15, - - - through inverters IN1, IN2, IN3, IN4, IN5, - - - . In this driving device, for example, when the electrode c is energized, a drive signal is supplied to the gate terminal of the field effect transistor Q13 through the inverter IN3 to turn on the transistor Q13. The field effect transistors Q22 and Q24 are also turned on. At this time, a charge current flows through a path: VDD>transistor Q13>capacitance CL2>transistor Q22>ground line, and a charge current flows through a path: VDD>transistor Q13>capacitance CL3>transistor Q24>ground line, thereby charging the capacitances CL2 and CL3. When the capacitances CL2 and CL3 are to be discharged, the field effect transistors Q13, Q22, and Q24 are turned off, and the field effect transistor Q23 is turned on. At this time, a discharge current flows through a path: ground line>diode D2>capacitance CL2>transistor Q23>ground line, and a discharge current flows through a path: ground line>diode D4>capacitance CL3>transistor Q23>ground line, thereby discharging the capacitances CL2 and CL3.

With the charging and discharging, the piezoelectric element between the electrodes b and c and the piezoelectric element between the electrodes c and d are distorted. Since an ink chamber is temporarily expanded and then returns to the original state, ink in the ink chamber is ejected via the nozzle by a pressure applied thereto.

When such a head driving device is incorporated in a semiconductor substrate to be an IC (integrated circuit), the following problem is raised. More specifically, since the diodes D2 and D4 are turned on in discharging, the voltages of the electrodes b and d are lower than the ground potential by a forward voltage drop across a PN contact. In this case, since parasitic diodes are formed between the electrodes b and d and the back gates of the field effect transistors Q22 and Q24, part of the discharge current also flow in both the parasitic diodes. The reliability of the IC is degraded due to the currents which flow in the semiconductor substrate. In addition, inter-element isolation is degraded, and, in the worst case, latch up may occur.

BRIEF SUMMARY OF THE INVENTION

It is an object of the present invention to provide a head driving device for an ink-jet printer, which can be manufactured as a reliable IC which is not easily influenced by a parasitic active element created therein, and does not cause degradation of inter-element isolation and latch up.

According to the first aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, and a plurality of second semiconductor switching elements connected between the electrodes and a second power supply terminal having a potential different from that of the first power supply terminal, wherein ink is ejected from each ink chamber due to the variation in pressure which is caused by charging and discharging of corresponding capacitances under a control of selectively turning on the first and second semiconductor switching elements; both of the first semiconductor switching elements and second semiconductor switching elements are formed on one semiconductor substrate; and the potential of the semiconductor substrate is set to be out of a range between the potentials of the first and second power supply terminals.

According to the second aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, and a plurality of second semiconductor switching elements connected between the electrodes and a second power supply terminal having a potential lower than that of the first power supply terminal, wherein ink is ejected from a predetermined ink chamber due to the variation in pressure which is caused by charging and discharging of two capacitances each across the electrode for the predetermined ink chamber and the electrodes for a corresponding ink chamber adjacent to the predetermined ink chamber under a charging control of turning on and off the respective first and second semiconductor switching elements connected to the electrode for a predetermined ink chamber and turning off and on the respective first and second semiconductor switching elements connected to the electrodes of the ink chambers adjacent to the predetermined ink chamber, and a subsequent discharging control of turning off and on the respective first and second semiconductor switching elements connected to the electrode for a predetermined ink chamber, both of the first semiconductor switching elements and second semiconductor switching elements are formed on one semiconductor substrate; and the potential of the semiconductor substrate is set to be out of a range between the potentials of the first and second power supply terminals.

According to the third aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, and a plurality of second semiconductor switching elements connected between the electrodes and a second power supply terminal having a potential different from that of the first power supply terminal, wherein ink is ejected from each ink chamber due to the variation in pressure which is caused by charging and discharging of corresponding capacitances under a control of selectively turning on the first and second semiconductor switching elements; at least one of groups of the first semiconductor switching elements and second semiconductor switching elements are constituted by MOS transistors formed on an integrated circuit; and the potential of a back gate of each MOS transistor is set to be out of a range between the potentials of a source and drain of the MOS transistor.

According to the fourth aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, and a plurality of second semiconductor switching elements connected between the electrodes and a second power supply terminal having a potential lower than that of the first power supply terminal, wherein ink is ejected from a predetermined ink chamber due to the variation in pressure which is caused by charging and discharging of two capacitances each across the electrode for the predetermined ink chamber and the electrodes for a corresponding ink chamber adjacent to the predetermined ink chamber under a charging control of turning on and off the respective first and second semiconductor switching elements connected to the electrode for a predetermined ink chamber and turning off and on the respective first and second semiconductor switching elements connected to the electrodes of the ink chambers adjacent to the predetermined ink chamber, and a subsequent discharging control of turning off and on the respective first and second semiconductor switching elements connected to the electrode for a predetermined ink chamber, at least one of groups of the first semiconductor switching elements and second semiconductor switching elements is constituted by MOS transistors formed on an integrated circuit; and the potential of a back gate of each MOS transistor is set to be out of a range between the potentials of a source and drain of the MOS transistor.

According to the fifth aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, and a plurality of second semiconductor switching elements connected between the electrodes and a second power supply terminal having a potential different from that of the first power supply terminal, wherein ink is ejected from each ink chamber due to the variation in pressure which is caused by charging and discharging of corresponding capacitances under a control of selectively turning on the first and second semiconductor switching elements; at least the second semiconductor switching elements are constituted by MOS transistors, the capacitances are discharged through the MOS transistors which are turned on by an identical potential applied to the gates thereof.

According to the sixth aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, a plurality of second semiconductor switching elements connected between the electrodes and a second power supply terminal having a potential different from that of the first power supply terminal, and a plurality of third semiconductor switching elements each connected between adjacent two electrodes, wherein ink is ejected from each ink chamber due to the variation in pressure which is caused by charging and discharging of corresponding capacitances under a charging and discharging control of selectively turning on the first and second semiconductor switching elements and a discharging control of selectively turning on the third semiconductor switching elements.

According to the seventh aspect of the present invention, there is provided a head driving device for an ink-jet printer, comprising an ink-jet head having a plurality of ink chambers, electrodes for the respective ink chambers, and electrostrictive elements which are arranged to separate the ink chambers and form a series of capacitances connected by the electrodes and which cause variations in pressure in the ink chambers by electrostriction, electrodes for the respective ink chambers, a plurality of first semiconductor switching elements connected between a first power supply terminal and the electrodes, a plurality of second semiconductor switching elements connected between the electrodes and a second power supply terminal having a potential lower than that of the first power supply terminal, and a plurality of third semiconductor switching elements each connected between adjacent two electrodes, wherein ink is ejected from a predetermined ink chamber due to the variation in pressure which is caused by charging and discharging of two capacitances each across the electrode for the predetermined ink chamber and the electrode for a corresponding ink chamber adjacent to the predetermined ink chamber under a charging control of turning on and off the respective first and second semiconductor switching elements connected to the electrode for a predetermined ink chamber, turning off and on the respective first and second semiconductor switching elements connected to the electrodes of the ink chambers adjacent to the predetermined ink chamber, and turning off the third semiconductor switching elements connected between the adjacent two electrodes, and a subsequent discharging control of turning off the respective first semiconductor switching element connected to the electrode for a predetermined ink chamber, and turning on the third semiconductor switching elements connected between the adjacent two electrodes.

According to the eighth aspect of the present invention, there is provided a head driving device for an ink-jet printer which has the same arrangement as that of the head driving device provide according to the sixth or seventh aspect, wherein the third semiconductor switching elements are constituted by MOS transfer gates.

Each of the head driving devices according to the first to eighth aspects can be manufactured as a reliable IC which is not easily influenced by a parasitic active element created therein, and does not cause degradation of inter-element isolation and latch up.

In the head driving device according to the fifth aspect, since no diode is used in the discharge path, the circuit configuration can be simplified.

In each of the head driving devices according to the sixth to eighth aspects, furthermore, the loop resistance of the discharge path can be decreased, and the head can be operated at a high speed.

In each of the head driving devices according to the sixth and eighth aspects, furthermore, erroneous ejection of ink can be prevented by decreasing the discharging speed of the capacitance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A head driving device according to the first embodiment of the present invention will be described below.

Figure 1A:
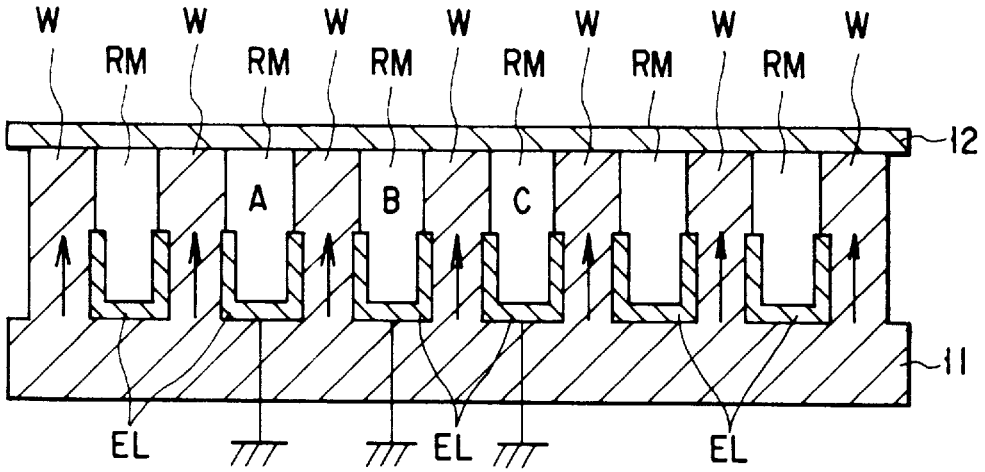
FIGS. 1A to 1C are sectional views for explaining operations of a multi-nozzle ink-jet head used in each embodiment of the present invention.
Figure 1B:
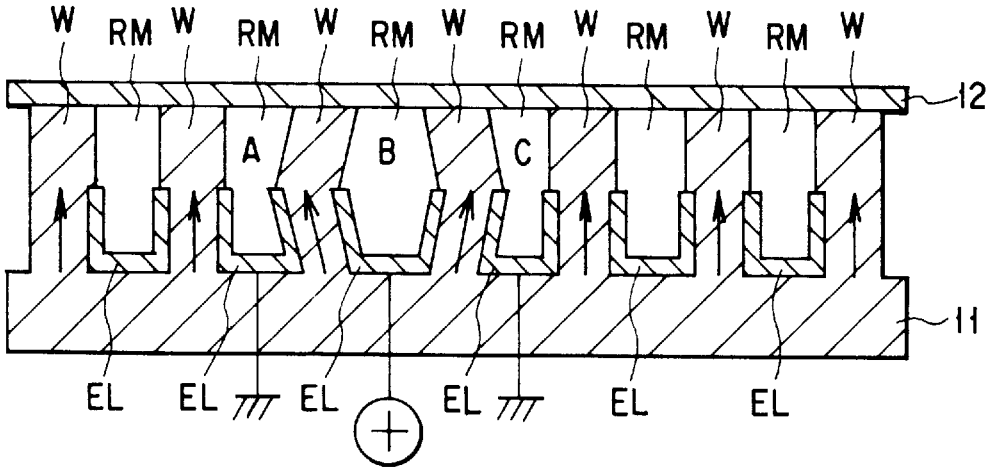
Figure 1C:
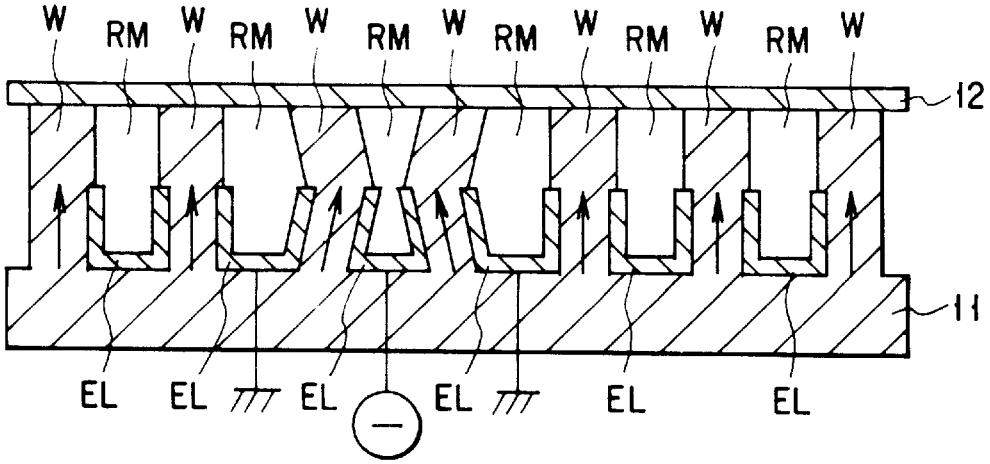

FIG. 1 shows the arrangement of a multi-nozzle ink-jet head. A plurality of recessed grooves are formed in a piezoelectric member 11 at predetermined pitches, and an upper lid 12 is fixed on the grooves to form ink chambers RM in association with the grooves. An electrode EL is spread over the bottom portion and side walls of each ink chamber RM. A nozzle (not shown) is formed in front of each ink chamber RM, and an ink supply port (not shown) is formed in the rear of each ink chamber RM. In this head, the piezoelectric member 11 has portions forming walls which separate the ink chambers RM from each other and serve as piezoelectric (or electrostrictive) elements W interposed between the electrodes EL. The respective piezoelectric elements W are polarized upward as indicated by arrows in FIGS. 1A to 1C.

In this ink-jet head, the electrodes EL are normally grounded as shown in FIG. 1A. When a positive voltage is applied to a selected electrode EL as shown in FIG. 1B, two piezoelectric elements W between the selected electrode EL and the electrodes EL adjacent thereto are externally distorted to expand the ink chamber RM in which the selected electrode EL is present. In contrast to this, as shown in FIG. 1C, when a negative voltage is applied to the selected electrode EL, the two piezoelectric elements W between the selected electrode EL and the electrodes EL adjacent thereto are internally distorted to compress the ink chamber RM in which the selected electrode EL is present. Therefore, in the ink-jet head, when the state of the ink chamber RM is changed into two or more states (of the three states show in FIGS. 1A, 1B, and 1C) including at least the state shown in FIG. 1A, ink can be ejected from the nozzle (orifice surface). The amount, speed, shape, stability, and the like of ejected ink droplets are determined depending on a combination among the order, duration, and rate of the change of three states shown in FIGS. 1A, 1B, and 1C and an amount of distortion. In general, these conditions are optimized by experiments. In addition, the driving conditions are adjusted to change the amount, speed, shape, stability, and the like of ink droplets, if it is necessary to obtain gradations or compensate for differences between the characteristics of paper, ink, a head, or the like.

Figure 2:
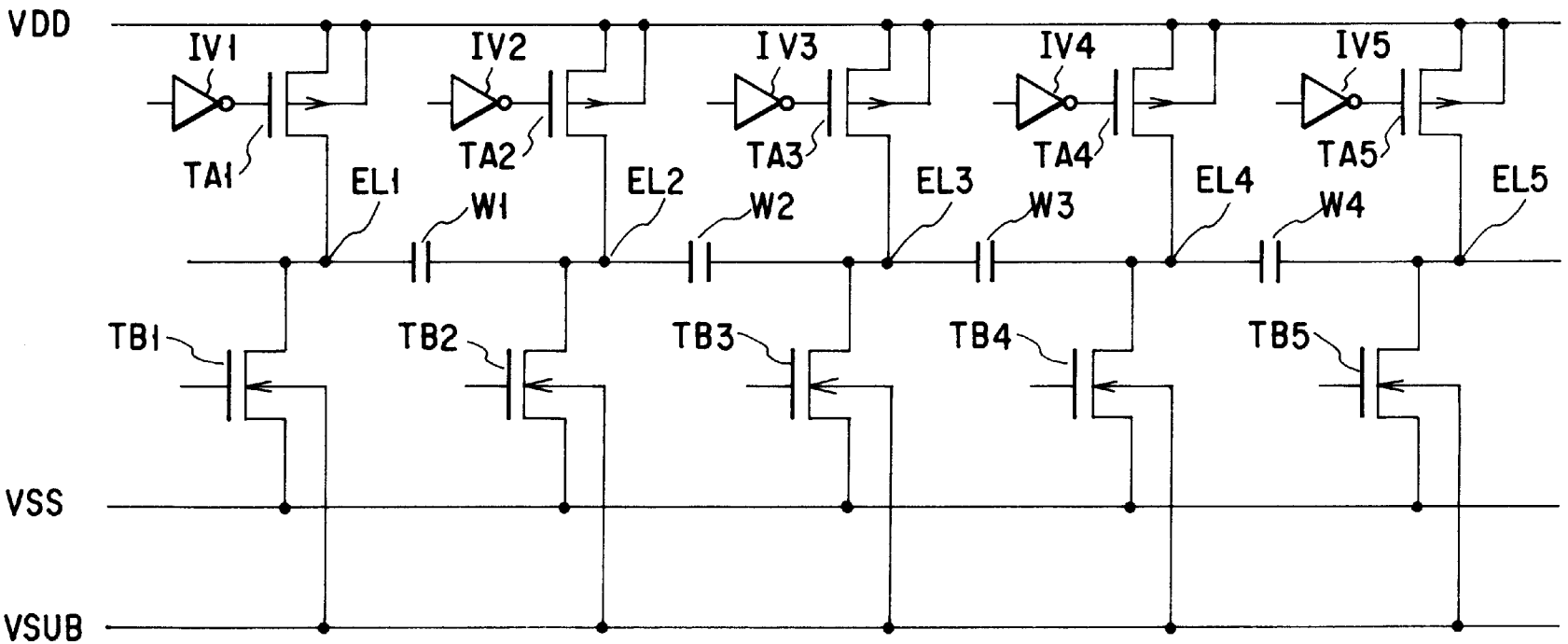
FIG. 2 is a circuit diagram showing the arrangement of a head driving device according to the first embodiment of the present invention.

The head driving device has the arrangement shown in FIG. 2 to drive the multi-nozzle ink-jet head as described above. More specifically, the equivalent circuit of the ink-jet head is a series circuit of capacitances W1, W2, W3, W4, - - - constituted by piezoelectric elements W which are connected in series via the electrodes EL1, EL2, EL3, EL4, EL5, - - - .

With this circuit, p-channel MOS field effect transistors TA1, TA2, TA3, TA4, TA5, - - - serving as first semiconductor switching elements are connected between a VDD power supply terminal to which a VDD voltage is applied and the electrodes EL1, EL2, EL3, EL4, EL5, - - - , and n-channel MOS field effect transistors TB1, TB2, TB3, TB4, TB5, - - - serving as second semiconductor switching elements are connected between a VSS power supply terminal to which a VSS voltage lower than the VDD voltage is applied and the electrodes EL1, EL2, EL3, EL4, EL5, - - - . The back gates of the p-channel MOS field effect transistors TA1, TA2, TA3, TA4, TA5, - - - are connected to the VDD power supply terminal, and the back gates of the n-channel MOS field effect transistors TB1, TB2, TB3, TB4, TB5, - - - are connected to a VSUB power supply terminal having a potential different from those of the VDD power supply terminal and the VSS power supply terminal. When the field effect transistors TA1, TA2, TA3, TA4, TA5, - - - and the field effect transistors TB1, TB2, TB3, TB4, TB5, - - - are incorporated in a semiconductor substrate (shown later as SUB) to constitute the integrated circuit, the VSUB potential of the VSUB power supply terminal is applied to the semiconductor substrate of the integrated circuit.

A drive signal is supplied to the gate terminals of the field effect transistors TA1, TA2, TA3, TA4, TA5, - - - through inverters IV1, IV2, IV3, IV4, IV5, - - - .

In this head driving device, for example, the VDD potential is set to 20V, the VSS potential is set to 0V, and the VSUB potential is set to −5V. A current rarely flows to the VSUB power supply terminal, and the VSUB power supply terminal does not require voltage precision. For this reason, −5V can be easily set by a charge pump or the like. More specifically, the head driving device may be mounted on the ink-jet head along with such a charge pump circuit to reduce an amount of wiring.

For example, a case wherein an ink is ejected from an ink chamber B will be described below. In a stationary state, a low-level drive signal is supplied to the gate terminals of the field effect transistors TA1, TA2, TA3, TA4, TA5, - - - through the inverters IV1, IV2, IV3, IV4, IV5, - - - , and the field effect transistors TA1, TA2, TA3, TA4, TA5, - - - are set in an OFF state. A high-level drive signal is supplied to the gate terminals of the field effect transistors TB1, TB2, TB3, TB4, TB5, - - - , and the field effect transistors TB1, TB2, TB3, TB4, TB5, - - - are set in an ON state. In this manner, the capacitances W1, W2, W3, W4, - - - are set in a discharge state. The state of the ink-jet head at this time is shown in FIG. 1A.

In this state, a high-level drive signal is supplied to the gate of the field effect transistor TA3 through the inverter IV3 to turn on the field effect transistor TA3, and a low-level drive signal is supplied to the gate of the field effect transistor TB3 to turn off the field effect transistor TB3. In this manner, a voltage of 20V is applied to electrode EL3 from the VDD power supply terminal to charge the capacitances W2 and W3. The charge path used at this time is as follows: VDD>transistor TA3>electrode EL3>capacitance W2>electrode EL2>transistor TB2>VSS and VDD>transistor TA3>electrode EL3>capacitance W3>electrode EL4>transistor TB4>VSS.

With this charging, the piezoelectric element W between the electrodes EL2 and EL3 and the piezoelectric element W between the electrode EL3 and EL4 are distorted externally when viewed from the ink chamber B to be set in the state of FIG. 1B.

In this state, when the field effect transistor TA3 is turned off, and the field effect transistor TB3 is turned on, the capacitances W2 and W3 are discharged. A discharge path used at this time is as follows: VSS>transistor TB2>electrode EL2>capacitance W2>electrode EL3>transistor TB3>VSS and VSS>transistor TB4>electrode EL4>capacitance W3>electrode EL3>transistor TB3>VSS.

With this discharging, the state of the ink chamber B returns to the original state of FIG. 1A. In this manner, the state of the ink chamber B changes from the state of FIG. 1A to the state of FIG. 1B and returns to the state of FIG. 1A. As a result, ink is ejected from the nozzle of the ink chamber B.

The terminals of the field effect transistors TB2 and TB4 on the VSS power supply terminal side serve as sources in charging, and serve as drains in discharging. The VSUB potential (−5V) lower than the VSS potential (0V) is applied to the back gates of the field effect transistors TB2 and TB4, and the back gates are isolated from the VSS potential. For this reason, when a voltage applied to the VSUB power supply terminal is set to be larger than a value obtained by subtracting a pn contact potential from a drop voltage generated by the field effect transistors TB2 and TB4 in discharging, no current from the semiconductor substrate is drawn to the field effect transistors TB2 and TB4. More specifically, when the VSS potential and the VSUB potential are set to 0V and −5V, the current from the semiconductor is not drawn.

In this manner, when the driving device is incorporated in the semiconductor substrate to form an IC, drawing of a current from the substrate potential does not occur. Therefore, when the driving device is mounted on an IC, the driving device is not easily influenced by parasitic active elements in the IC, and a head driving IC having high reliability can be obtained without causing degradation of inter-element isolation or latch up.

In the lines of the VSS power supply terminal, wiring is desirably performed such that the drains of the adjacent field effect transistors TB1, TB2, TB3, TB4, TB5, - - - are as close to each other as possible. Therefore, the loop of the discharge path in discharging can be decreased in size, and an influence of a rush current in discharging on the circuit can be reduced.

In this embodiment, since the field effect transistors TB1, TB2, TB3, TB4, TB5, - - - have bidirectional properties, diodes need not be parallel connected to the transistors to form a discharge path, thereby obtaining a simple circuit arrangement. Therefore, the driving device is mounted on an IC, an area occupied by the driving device can be advantageously decreased.

A head driving device according to the second embodiment of the present invention will be described below.

In this embodiment, although the driving device shown in FIG. 2 having the same arrangement as that in the first embodiment is used, the potentials of the VSS power supply terminal and the VSUB power supply terminal are set to be equal to each other. More specifically, when a discharge current is small in the driving device in FIG. 2, voltage drop occurring in the field effect transistors TB2 and TB4 is small. On the other hand, a current does not flow between the semiconductor substrate and the electrodes EL2 and EL4 until a potential difference larger than the forward voltage of the pn contact is generated. More specifically, a discharge current does not flow through a parasitic diode formed between the semiconductor substrate and the electrodes EL2 and EL4.

Therefore, when the discharge current is small, and voltage drop occurring in the field effect transistors TB2 and TB4 is sufficiently small, a discharge current does not flow in the semiconductor substrate even if VSS=VSUB is established. Under this condition, when VSS=VSUB is set, the number of types of power supplies can be decreased, and a simple structure can be obtained.

A head driving device according to the third embodiment of the present invention will be described below.

Figure 3:
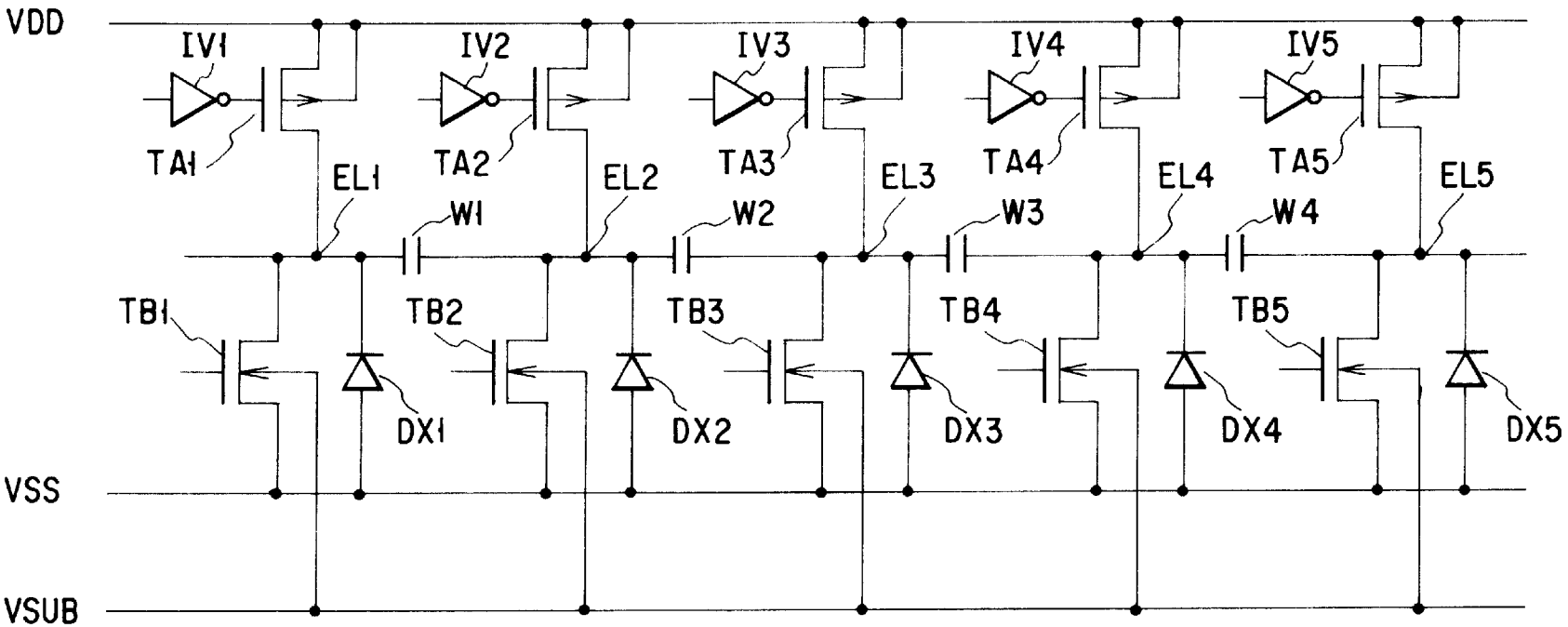
FIG. 3 is a circuit diagram showing the arrangement of a head driving device according to the third embodiment of the present invention.

The same reference numerals as in the first embodiment described above denote the same parts in the third embodiment, and a description thereof will be omitted. According to this embodiment, as shown in FIG. 3, diodes DX1, DX2, DX3, DX4, DX5, - - - are parallel connected to field effect transistors TB1, TB2, TB3, TB4, TB5, - - - to have reversed polarity. More specifically, the anodes of the diodes DX1, DX2, DX3, DX4, DX5, - - - are commonly connected to the VSS power supply terminal, and the cathodes of the diodes DX1, DX2, DX3, DX4, DX5, - - - are commonly connected to electrodes EL1, EL2, EL3, EL4, EL5, - - - .

In this manner, when the diodes DX1, DX2, DX3, DX4, DX5, - - - are parallel connected to the field effect transistors TB1, TB2, TB3, TB4, TB5, - - - , the head can be operated at a high speed. More specifically, the ON resistance of the field effect transistors TB1, TB2, TB3, TB4, TB5, - - - is generally higher than the ON resistance of the diodes DX1, DX2, DX3, DX4, DX5, - - - . Therefore, when the diodes DX1, DX2, DX3, DX4, DX5, - - - are arranged on the discharge path of capacitances W1, W2, W3, W4, - - - , discharging is performed at a high speed, and the head can be operated at a high speed. In this case, the head driving device is incorporated in the substrate to form an IC, drawing of a current from the substrate potential does not occur, and a head driving IC having high reliability can be structured.

A head driving device according to the fourth embodiment of the present invention will be described below.

Figure 4:
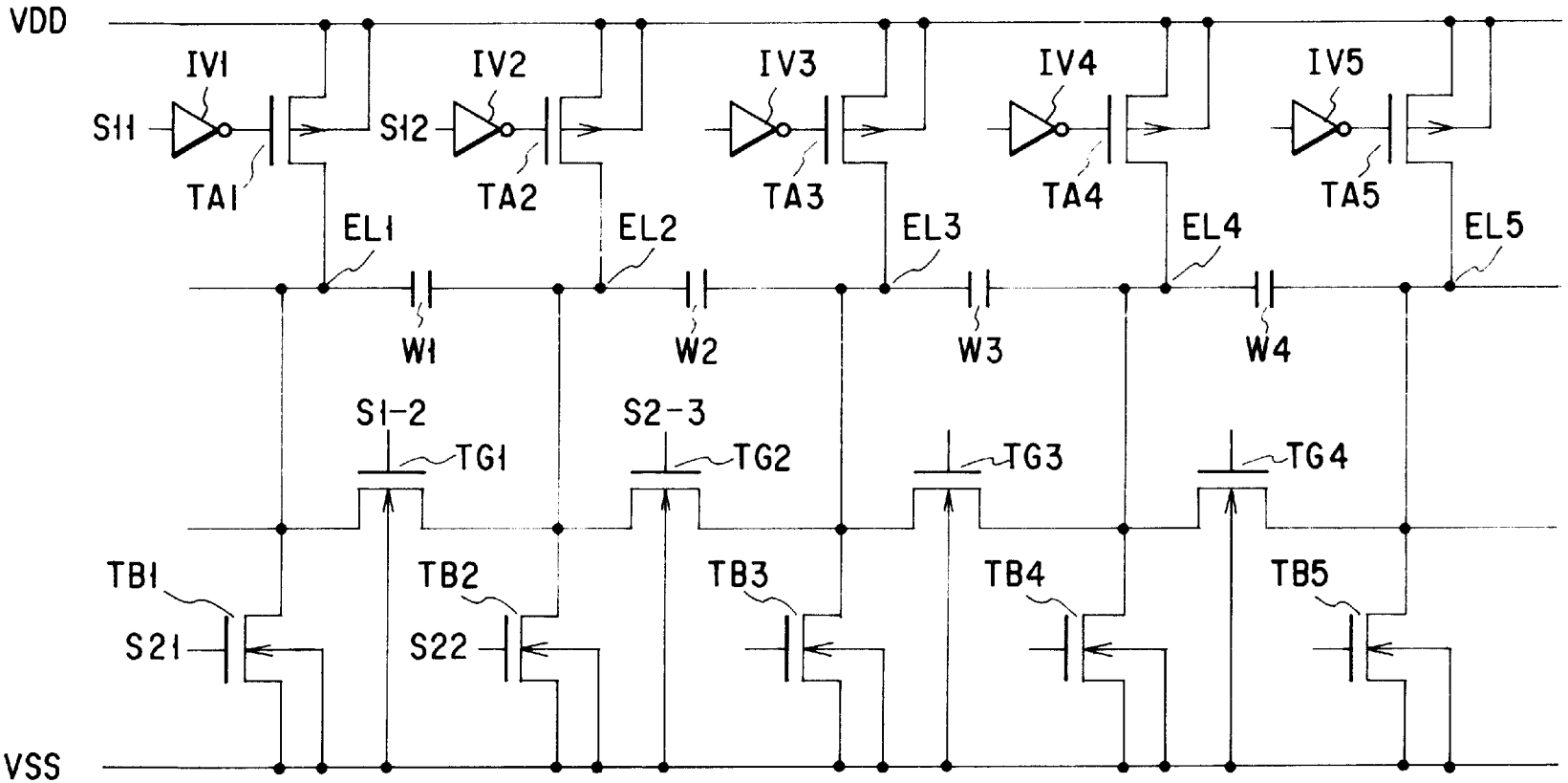
FIG. 4 is a circuit diagram showing the arrangement of a head driving device according to the fourth embodiment of the present invention.

The same reference numerals as in the first embodiment described above denote the same parts in the fourth embodiment, and a description thereof will be omitted. According to this embodiment, as shown in FIG. 4, MOS transfer gates (a kind of transistor) TG1, TG2, TG3, TG4, - - - serving as third semiconductor switching elements are connected in parallel with capacitances W1, W2, W3, W4, - - - . More specifically, the MOS transfer gate TG1 is connected between the electrodes EL1 and EL2, the MOS transfer gate TG2 is connected between the electrodes EL2 and EL3, the MOS transfer gate TG3 is connected between the electrodes EL3 and EL4, and the MOS transfer gate TG4 is connected to the electrodes EL4 and EL5.

In this head driving device, in an stationary state, the field effect transistors TA1, TA2, TA3, TA4, TA5, . . . are set in an OFF state, the field effect transistors TB1, TB2, TB3, TB4, TB5, - - - are set in an ON state, and the MOS transfer gates TG1, TG2, TG3, TG4, - - - are set in an OFF state.

In this state, when the field effect transistor TA3 is turned on, and the field effect transistor TB3 is turned off, the capacitances W2 and W3 are charged. A charge path used at this time is as follows: VDD>transistor TA3>electrode EL3>capacitance W2>electrode EL2>transistor TB2>VSS and VDD>transistor TA3>electrode EL3>capacitance W3>electrode EL4>transistor TB4>VSS.

In this state, when the field effect transistor TA3 is turned off, and the MOS transfer gates TG2 and TG3 are turned on, the capacitance W2 is discharged through the MOS transfer gate TG2, and the capacitance W3 is discharged through the MOS transfer gate TG2. In this manner, when the capacitances W2 and W3 are charged/discharged, ejection of ink is performed.

When the capacitances W2 and W3 are discharged, the field effect transistors TA3 and TB3 are set in an OFF state, and the field effect transistors TB2 and TB4 are set in an ON state. For this reason, the potentials at all the points are not lower than the VSS voltage. When the driving unit is mounted on an IC, drawing of a current from the substrate potential does not occur. Therefore, as in this embodiment, a head driving IC having high reliability can be structured.

In this driving device, since one capacitance is discharged by using only one MOS transfer gate, a charge path can be more shortened. Therefore, even if an ON resistance per transistor does not change, the loop resistance of the discharge path can be decreased, and the head can be operated at a high speed.

As described above, the MOS transfer gates TG2 and TG3 are turned on when charges for charging the capacitances W2 and W3 are discharged by a charge current flowing through the field effect transistor TA3. However, the MOS transfer gate TG2 is also turned on when reversely charges which charge the capacitance W2 are discharged by a charge current flowing through the field effect transistor TA2, and the MOS transfer gate TG4 is also turned on when charges which reversely charge the capacitance W3 are discharged by a charge current flowing through the field effect transistor TA4.

Figure 5A:
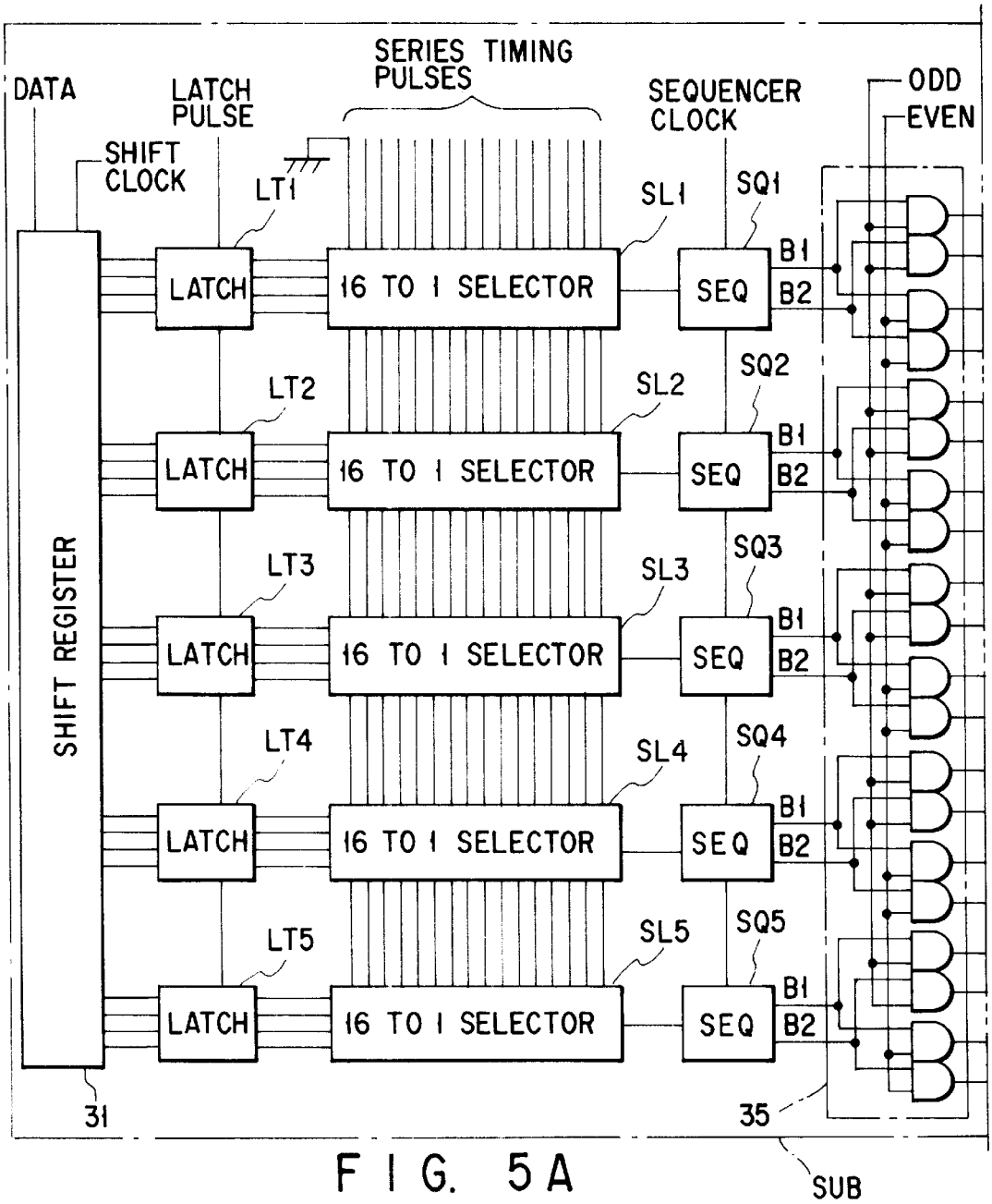
FIGS. 5A and 5B are block diagrams showing the arrangement of an entire control section using the head driving device according to the fourth embodiment.
Figure 5B:
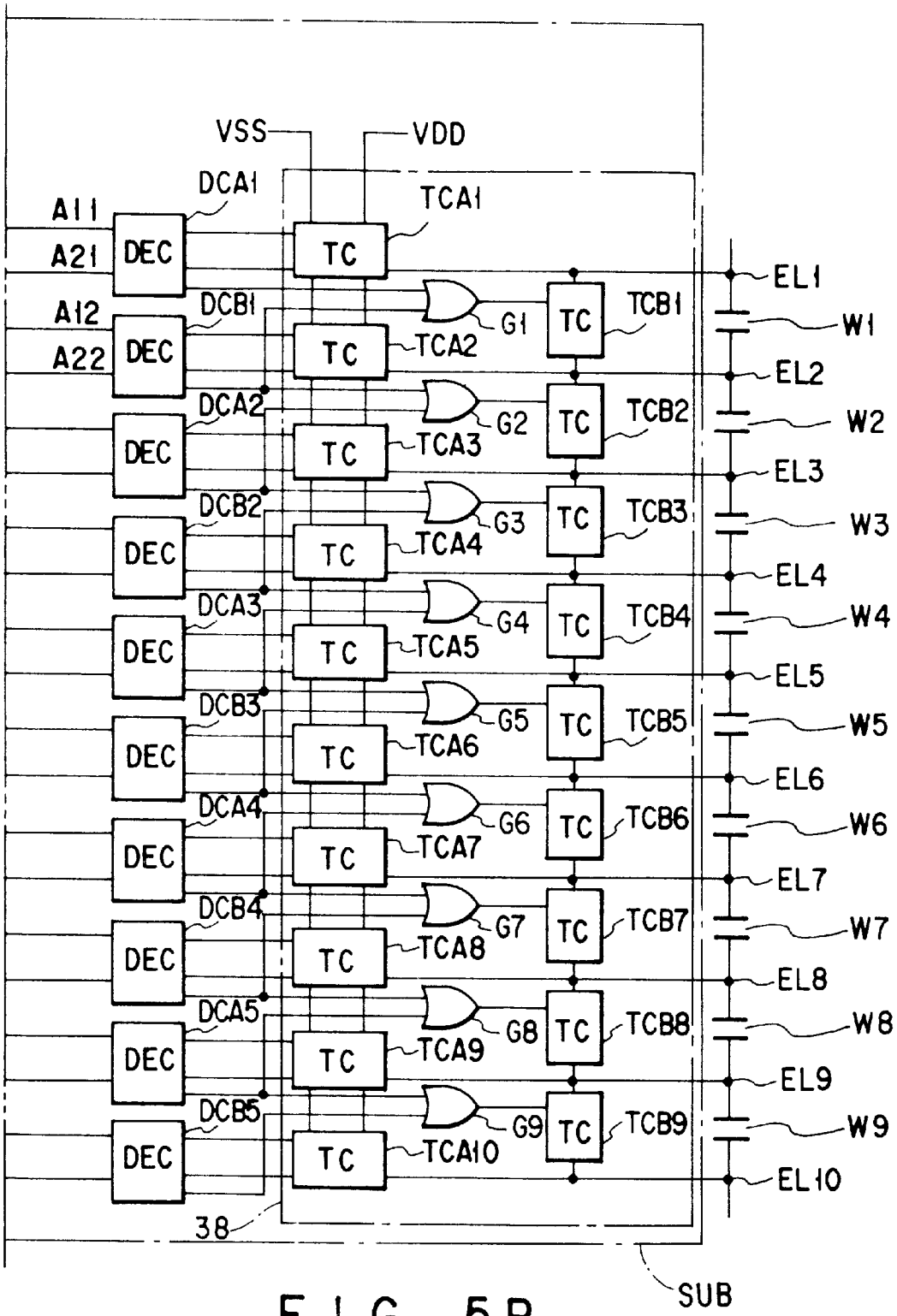

FIGS. 5A and 5B are block diagrams showing the arrangement of an entire control section including the head driving device in FIG. 4. In the control section, data to be printed are serially supplied to a shift register 31 and stored in the shift register 31 in synchronism with a shift clock. The data stored in the shift register 31 correspond to 4-bit gradation data for each nozzle, and the 4-bit gradation data are respectively latched by 4-bit latch circuits LT1, LT2, LT3, LT4, and LT5 by a latch pulse. After the data are latched, data to be printed next can be stored in the shift register 31.

The 4-bit gradation data latched by the 4-bit latch circuits LT1, LT2, LT3, LT4, and LT5 are supplied to 16 to 1 selectors SL1, SL2, SL3, SL4, and SL5, respectively. The selectors SL1, SL2, SL3, SL4, and SL5 selects one from 16 timing pulse strings additionally input on the basis of the values of the input gradation data, to output the selected timing pulse string. The selected timing pulses are supplied to 2-bit sequencers SQ1, SQ2, SQ3, SQ4, and SQ5, respectively. One of the 16 timing pulse strings is non-signal data for non-printing. The remaining W timing pulse strings are set to be pulse strings which are preset to control the 2-bit sequencers SQ1, SQ2, SQ3, SQ4, and SQ5 at a timing by a procedure in which amounts of ink to be ejected are set depending on respective gradations. The 2-bit sequencers SQ1, SQ2, SQ3, SQ4, and SQ5 convert the input timing pulse into control timing data B1 and B2 including the information of the order and time of four states, i.e., "0,0", "0,1", "1,0", and "1,1" in synchronism with a sequencer clock. The control timing data B1 and B2 from the sequencers SQ1, SQ2, SQ3, SQ4, and SQ5 are assigned to odd-number nozzles or even-number nozzles by a demultiplexer 35 constituted by a plurality of AND gates. More specifically, the demultiplexer 35 supplies the control timing data B1 and B2 from the sequencers SQ1, SQ2, SQ3, SQ4, and SQ5 to decoders DCA1, DCA2, DCA3, DCA4, and DCA5 in response to an odd-number selection signal ODD, respectively, and the demultiplexer 35 supplies the control timing data B1 and B2 from the sequencers SQ1, SQ2, SQ3, SQ4, and SQ5 to decoders DCB1, DCB2, DCB3, DCB4, and DCB5 in response to an even-number selection signal EVEN, respectively. Note that a signal "0,0" is supplied to the decoders DCB1, DCB2, DCB3, DCB4, and DCB5 corresponding to the even-number nozzles when the odd-number selection signal ODD is input, and to the decoders DCA1, DCA2, DCA3, DCA4, and DCA5 corresponding to the odd-number nozzles when the even-number selection signal EVEN is input.

Figure 6:
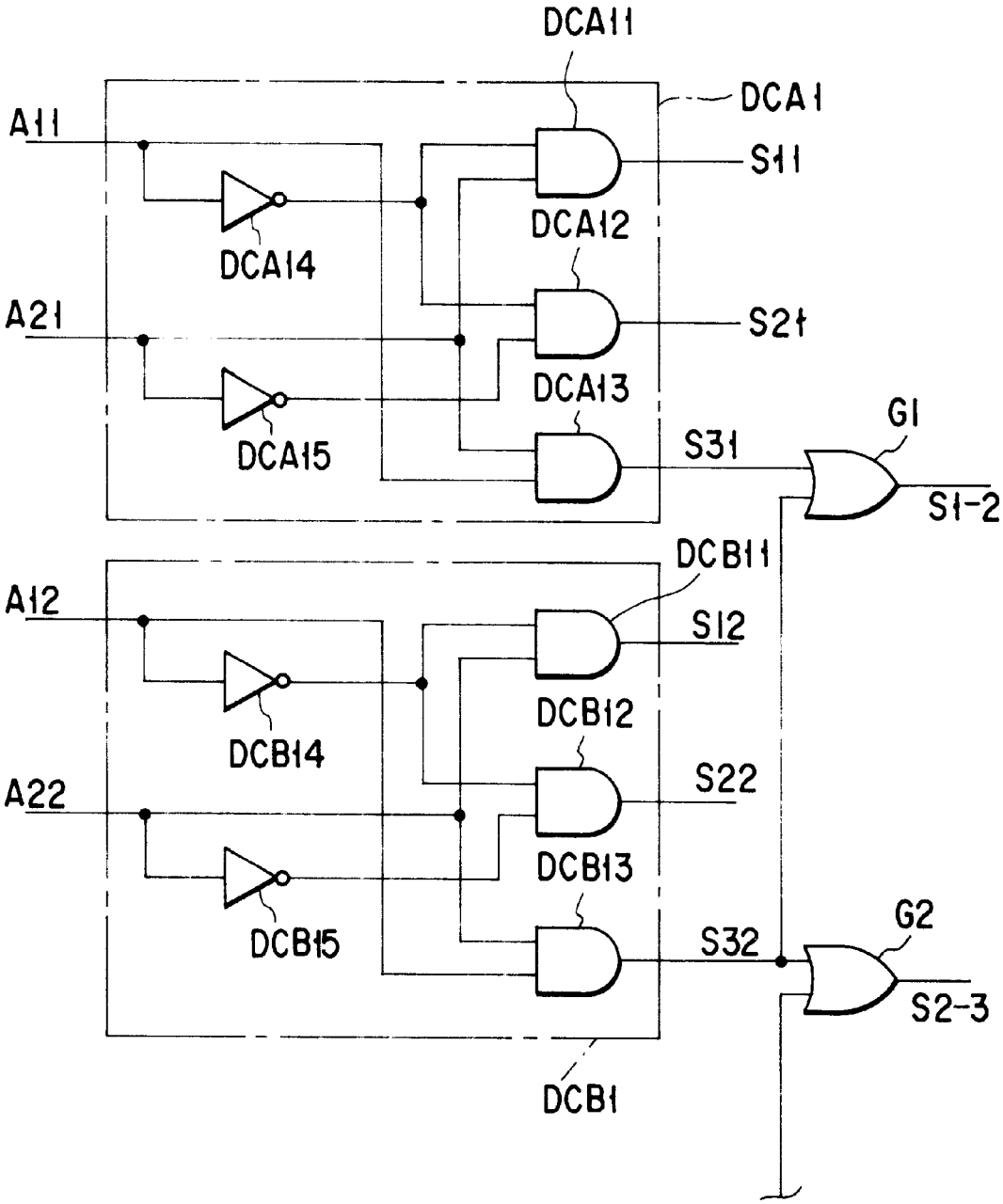
FIG. 6 is a circuit diagram of a decoder shown in FIG. 5B.

As shown in FIG. 6, the decoder DCA1 is constituted by three two-input AND gates DCA11, DCA12, and DCA13 and two inverters DCA14 and DCA15, and the decoder DCB1 is constituted by three two-input AND gates DCB11, DCB12, and DCB13 and two inverters DCB14 and DCB15. The decoder DCA1 directly inputs a signal A11 of two-bit signals A11 and A21 from the demultiplexer 35 to the AND gate DCA13, and inputs the signal A11 to the AND gates DCA11 and DCA12 through the inverter DCA14. The decoder DCA1 directly inputs the signal A21 to the AND gates DCA11 and DCA13, and inputs the signal A21 to the AND gate DCA12 through the inverter DCA15. The decoder DCB1 directly inputs a signal A12 of two-bit signals A12 and A22 from the demultiplexer 35 to the AND gate DCB13, and inputs the signal A12 to the AND gates DCB11 and DCB12 through the inverter DCB14. The decoder DCB1 directly inputs the signal A22 to the AND gates DCB11 and DCB13, and inputs the signal A22 to the AND gate DCB12 through the inverter DCB15.

A drive signal is supplied from the AND gates DCA11, DCA12, DCA13, DCB11, DCB12, and DCB13 to a head driving device 38. The head driving device 38 comprises transistor circuit sections TCA1 to TCA10, OR gates G1 to G9, and transistor circuit sections TCB1 to TCB9. The transistor circuit sections TCA1 to TCA10 have the field effect transistors TA1, TB1, TA2, TB2, TA3, TB3, TA4, TB4, TA5, TB5, - - - and the inverters IV1, IV2, IV3, IV4, IV5, - - - shown in FIG. 4. The transistor circuit sections TCB1 to TCB9 have the MOS transfer gates TG1, TG2, TG3, TG4, - - - shown in FIG. 4.

A drive signal S11 is supplied from the AND gate DCA11 of the decoder DCA1 to the inverter IV1 of the transistor circuit section TCA1, and a drive signal S21 is supplied from the AND gate DCA12 to the gate of the field effect transistor TB1 of the transistor circuit section TCA1. A drive signal S31 is output from the AND gate DCA13, and the drive signal S31 is supplied as a drive signal S1-2 to the gate of the MOS transfer gate TG1 of the transistor circuit section TCB1 through the OR gate G1. A drive signal S12 is supplied from the AND gate DCB11 of the decoder DCB1 to the inverter IV2 of the transistor circuit section TCA2, and a drive signal S22 is supplied from the AND gate DCB12 to the gate of the field effect transistor TB2 of the transistor circuit section TCA2. A drive signal S32 is output from the AND gate DCB13, and the drive signal S32 is supplied as a drive signal S1-2 to the gate of the MOS transfer gate TG1 of the transistor circuit section TCB1 through the OR gate G1, and is supplied as a drive signal S2-3 to the gate of the MOS transfer gate TG2 of the transistor circuit section TCB2 through the OR gate G2. Although the arrangements of the decoders DCA1 and DCB1 are described here, the arrangements of other decoders DCA2 to DCA5 and DCB2 to DCB5 are the same as those of the decoders DCA1 and DCB1.

The output terminals of the transistor circuit sections TCA1 to TCA10 are connected to electrodes EL1 to EL10 connected to capacitances W1 to W9, respectively. The input/output relationship among the decoders DCA1 to DCA5 and DCB1 to DCB5 is expressed by a truth table, and the output states of the head driving device 38 corresponding to the truth table are shown in the following table:

TABLE 1

| A1 | A2 | S1X | S2X | S3X | OUTPUT |
|---|---|---|---|---|---|
| 0 | 0 | L | H | L | VSS VOLTAGE |
| 0 | 1 | H | L | L | VDD VOLTAGE |
| 1 | 0 | H | L | L | OFF |
| 1 | 1 | L | L | H | SHORT-CIRCUIT LOOP |

Symbol A1 indicates the signals A11, A12, - - - , and symbol A2 indicates the signals A21, A22, - - - . Symbol S1X indicates the drive signals S11, S12, - - - , symbol S2X indicates the drive signals S21, S22, - - - , and symbol S3X indicates the drive signals S31, S32, - - - .

As is apparent from Table 1, when signal A1=0 and A2=0 are established, drive signal S1X=L (low level), S2X=H (high level), and S3X=L (low level). At this time, a VSS voltage is applied to the corresponding electrode. When signal A1=0 and A2=1 are established, drive signal S1X=H, S2X=L, and S3X=L. At this time, a VDD voltage is applied to the corresponding electrode. When signal A1=1 and A2=0 are established, drive signal S1X=L, S2X=L, and S3X=L. At this time, a voltage applied to the corresponding electrode is turned off. When signal A1=1 and A2=1 are established, drive signal S1X=L, S2X=L, and S3X=H. At this time, the corresponding electrodes are short-circuited by the MOS transfer gates TG1, TG2, TG3, TG4, - - - to constitute a discharge loop.

In the control section with the above arrangement, 4-bit gradation data for driving odd-number nozzles, i.e., (odd-number)th ink chambers, are stored in the shift register 31 and then latched by the 4-bit latch circuits LT1 to LT5. The latched gradation data are supplied to the 16 to 1 selectors SL1 to SL5 to be converted into one timing pulse. The timing pulses from the selectors SL1 to SL5 are supplied to the 2-bit sequencers SQ1 to SQ5, respectively, to be converted into control timing data B1 and B2. The control timing data B1 and B2 from the sequencers SQ1 to SQ5 are supplied to the demultiplexer 35. The demultiplexer 35 supplies the control timing data B1 and B2 from the sequencers SQ1 to SQ5 to the decoders DCA1 to DCA5 corresponding to the odd-number nozzles, respectively. The transistor circuit sections TCA1, TCA3, TCA5, TCA7, and TCA9 and the transistor circuit sections TCB1 to TCB9 are selectively driven by signals from the decoders DCA1 to DCA5. In this manner, the capacitances W1 to W9 are selectively charge/discharge-controlled, and the piezoelectric elements constituting the partition walls of the ink chambers are distorted to give pressures to desired ink chambers, thereby ejecting predetermined amounts of ink depending on the gradation data.

For example, when the third nozzle is driven, the second and fourth nozzles adjacent to the third nozzle are (even-number)th nozzles which are not assigned. At this time, ink is ejected from the ink chamber corresponding to the third nozzle, and no ink is ejected from the ink chambers adjacent to the third nozzle. In this manner, the (odd-number)th nozzles and the (even-number)th nozzles are alternately driven to perform printing.

A head driving device according to the fifth embodiment of the present invention will be described below.

According to this embodiment, another driving method is realized by using the driving device shown in FIG. 4 as in the fourth embodiment. In this head driving device, in a stationary state, field effect transistors TA1, TA2, TA3, TA4, TA5, - - - are set in an OFF state, field effect transistors TB1, TB2, TB3, TB4, TB5, - - - are set in an OFF state, and MOS transfer gates TG1, TG2, TG3, TG4, - - - are set in an ON state.

In this state, when the field effect transistors TA3, TB2, and TB4 are turned on, and the MOS transfer gates TG2 and TG3 are turned off, capacitances W2 and W3 are charged. A charge path used at this time is as follows: VDD>transistor TA3>electrode EL3>capacitance W2>electrode EL2>transistor TB2>VSS and VDD>transistor TA3>electrode EL3>capacitance W3>electrode EL4>transistor TB4>VSS. At this time, ink chamber B are expanded as shown in FIG. 1B to absorb ink from ink supply ports.

The field effect transistors TA3, TB2, and TB4 are turned off, and the field effect transistors TA2, TA4, and TB3 are turned on. In this manner, the capacitances W2 and W3 are reversely charged. A charge path used at this time is as follows: VDD>transistor TA2>electrode EL2>capacitance W2>electrode EL3>transistor TB3>VSS and VDD>transistor TA4>electrode EL4>capacitance W3>electrode EL3>transistor TB3>VSS. At this time, ink chamber B are compressed as shown in FIG. 1C to eject ink from nozzles.

Thereafter, when the field effect transistors TA2, TA4, and TB3 are turned off, and the MOS transfer gates TG2 and TG3 are turned on, the capacitance W2 is discharged through the MOS transfer gate TG2, and the capacitance W3 is discharged through the MOS transfer gate TG3. As a result, the state of the ink chamber B returns to the state shown in FIG. 1A. In this manner, ink ejection is performed by charging, reversely charging, and discharging the capacitances W2 and W3.

Since all the field effect transistors TA2, TA3, TA4, TB2, TB3, and TB4 are set in an OFF state when the capacitances W2 and W3 are discharged, there is no current path to the VSS power supply terminal or the VDD power supply terminal. Therefore, drawing of a current from the substrate potential does not occur. Therefore, in this embodiment, a head driving IC having high reliability can be structured.

In this embodiment, ink ejection is performed during reverse charging, and then, discharging is performed. Therefore, the following method may be effective to prevent erroneous ejection. That is, discharging is slowly performed depending on conditions such as the properties of ink such that the discharging rate is not extremely high, thereby suppressing an abrupt change in ink pressure. In such a case, the ON resistance of the MOS transfer gates TG1 to TG4 may be set to be high, and a time constant determined by the capacitances W1 to W4 and the ON resistance of the MOS transfer gates TG1 to TG4 may be set to be large.

Figure 7A:
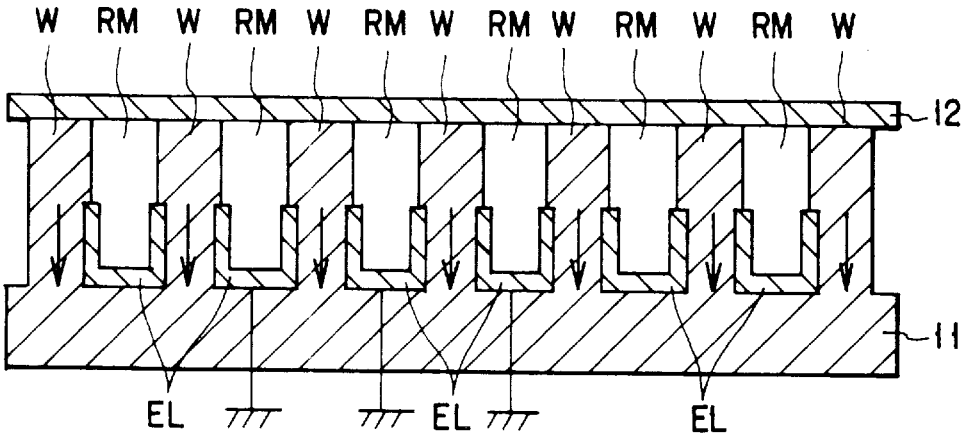
FIGS. 7A to 7C are sectional views showing another arrangement of a multi-nozzle ink-jet head used in each embodiment of the present invention.
Figure 7B:
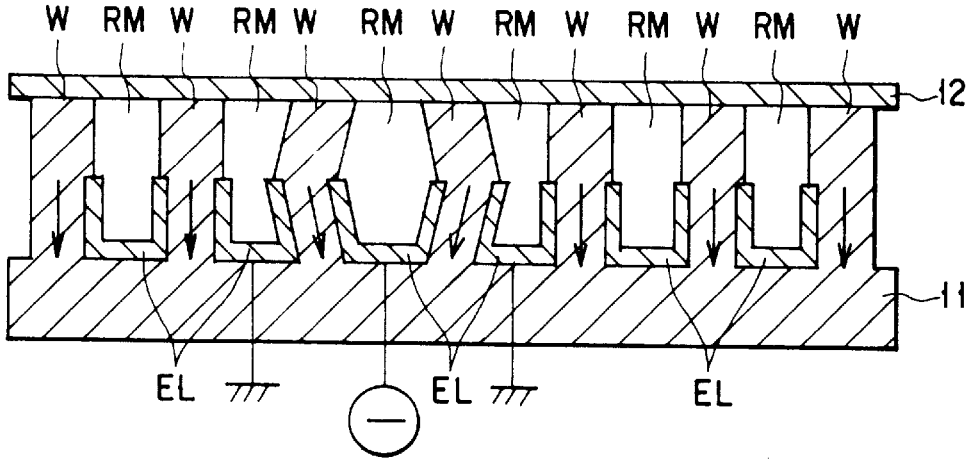
Figure 7C:
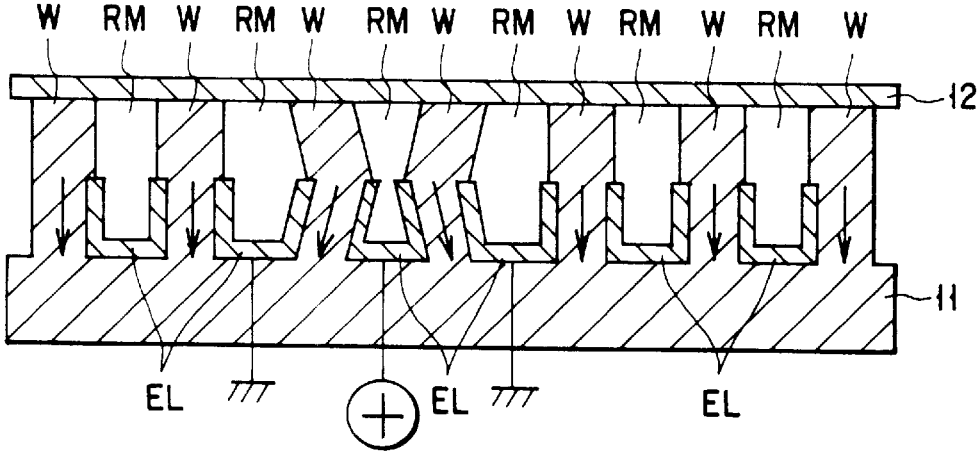
Figure 8:
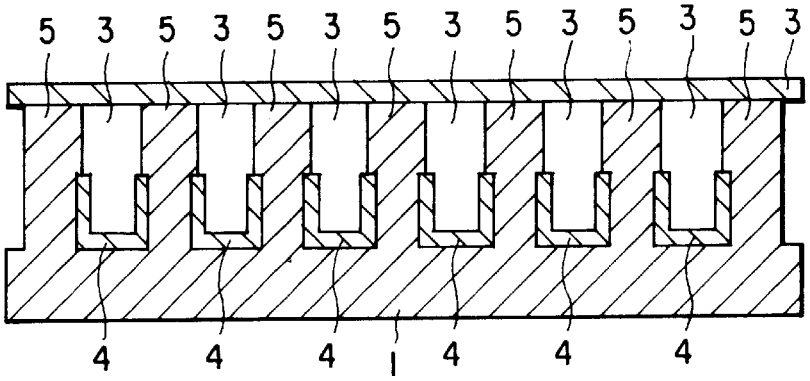
FIG. 8 (PRIOR ART)
FIG. 8 is a sectional view showing the arrangement of a typical multi-nozzle ink-jet head.
Figure 9:
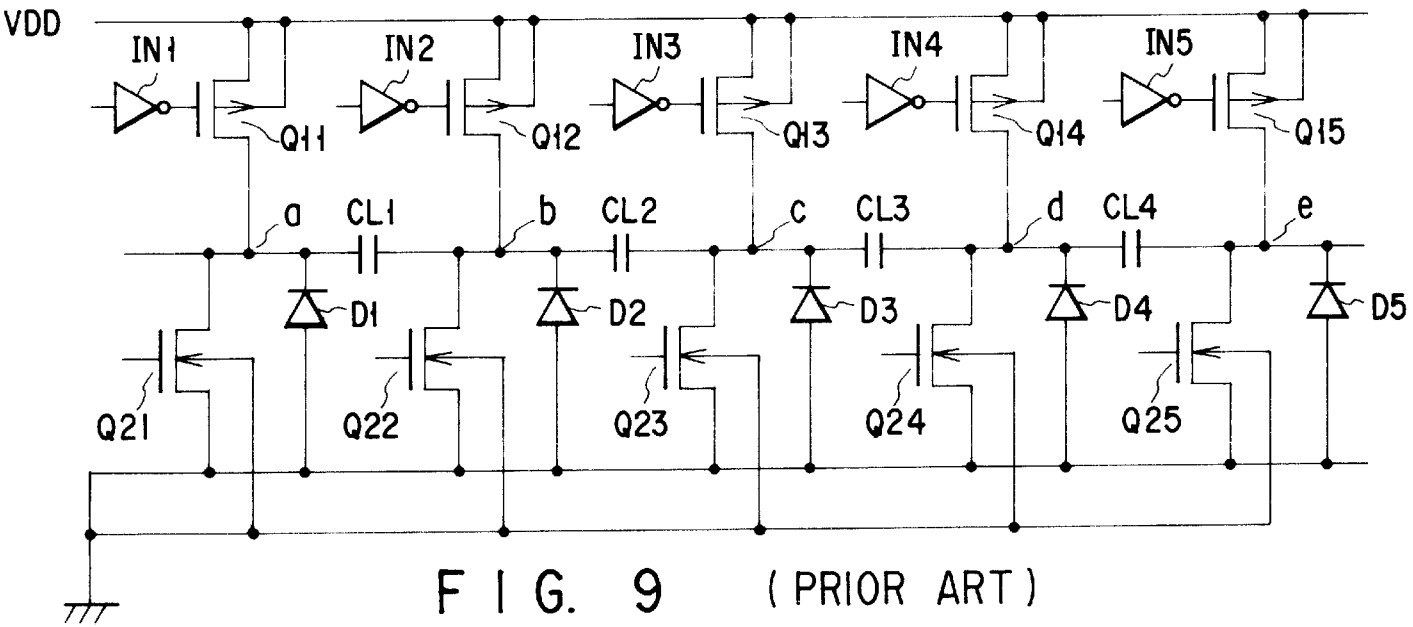
FIG. 9 (PRIOR ART)
FIG. 9 is a circuit diagram showing the arrangement of a conventional head driving device.

In each of the embodiments, a head driving device using, as a multi-nozzle ink-jet head, a head in which piezoelectric elements W constituting partition walls are polarized in the upper direction, i.e., in the direction of the upper lid 12. However, the present invention is not limited to these embodiments, and, as shown in FIGS. 7A to 7C, a head in which piezoelectric elements W constituting partition walls are polarized in the lower direction may be used. In this case, in contrast to the case shown in FIG. 1, as shown in FIG. 7B, when a negative voltage EL is applied to a given electrode, a piezoelectric element W between the given electrode EL and an electrode EL adjacent thereto is distorted externally to expand the ink chamber RM in which the given electrode EL is formed. In contrast to this, as shown in FIG. 7C, when a positive voltage is applied to a given electrode EL, a piezoelectric element W between the given electrode EL and an electrode EL adjacent thereto is distorted internally to compress the ink chamber RM in which the given electrode EL is formed. Therefore, when this head is used, a head driving device corresponding to the head is used.

In each of the embodiments, a piezoelectric element is used as an electrostrictive element. However, the piezoelectric element is not limited to the electrostrictive element. An electrostrictive element using electrostatic force may be used. In each embodiment, the electrostrictive element directly constitutes the wall surface of an ink chamber. However, the present invention is not limited to this arrangement, and an electrostrictive element may indirectly distort the wall surface of the ink chamber. In short, the pressure in an ink chamber may be only changed by electrostriction of the electrostrictive element.

As the head of an ink-jet printer to which the present invention is applied, a head in which electrostrictive elements are different in mechanical structure, but constitute capacitances connected in series with each other can be used.

The embodiments of the present invention has been described above. The present invention is not limited to only the embodiments described above, and the change and modification of the present invention can be effective as necessary without departing from the spirit and scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A head driving device for an ink-jet head including a plurality of ink chambers and electrostrictive members, each electrostrictive member including a first electrode and a second electrode, said first and second electrodes forming a capacitance and varies pressure in a corresponding ink chamber by electrostriction caused upon charging and discharging of the capacitance, the head driving device comprising:

a first power supply terminal and a second power supply terminal set at respective potentials different from each other; and a control circuit coupled to the first and second power supply terminals and to the first and second electrodes of each of the electrostrictive members for charging and discharging the capacitance of each of said electrostrictive members with use of the potentials of said first and said second power supply terminals; and wherein:

said control circuit includes an integrated circuit chip having a semiconductor substrate and plural pairs of a first switching element and a second switching element, said first and second switching elements being formed in said semiconductor substrate, the first electrode of each electrostrictive member is connected to the first and second power supply terminals respectively through the first and second switching elements of one pair of said plural pairs of switching elements, the second electrode of each electrostrictive member is connected to said first and second power supply terminals respectively through the first and second switching elements of another pair of said plural pairs of switching elements, and said semiconductor substrate is set at a potential out of a range between the potentials of said first and said second power supply terminals.

2. A head driving device according claim 1, wherein:

the potential of said first power supply terminal is higher than the potential of said second power supply terminal, and said integrated circuit chip is arranged such that the capacitance of each electrostrictive member is charged by turning on the first switching element connected to the first electrode of the respective capacitance and the second switching element connected to the second electrode of the respective capacitance and turning off the first switching element connected to the second electrode of the respective capacitance and the second switching element connected to the first electrode of the respective capacitance, and is discharged by turning on the second switching elements connected to the first and the second electrodes of the respective capacitance and turning off the first switching elements connected to the first and the second electrodes of the respective capacitance.

3. A head driving device for an ink-jet head including a plurality of ink chambers and electrostrictive members, each electrostrictive member including a first electrode and a second electrode, said first and second electrodes forming a capacitance and varies pressure in a corresponding ink chamber by electrostriction caused upon charging and discharging of the capacitance, the head driving device comprising:

a first power supply terminal and a second power supply terminal set at respective potentials different from each other; and a control circuit coupled to the first and second power supply terminals and to the first and second electrodes of each of the electrostrictive members for charging and discharging the capacitance of each of said electrostrictive members with use of the potentials of said first and said second power supply terminals; and wherein:

said control circuit includes an integrated circuit chip having a semiconductor substrate and plural pairs of a first switching element and a second switching element, said first and second switching elements being formed in said semiconductor substrate, the first electrode of each electrostrictive member is connected to the first and second power supply terminals respectively through the first and second switching elements of one pair of said plural pairs of switching elements, the second electrode of each electrostrictive member is connected to said first and second power supply terminals respectively through the first and second switching elements of another pair of said plural pairs of switching elements, and at least one group selected from a group of said first switching elements and a group of said second switching elements is formed of MOS transistors having back gates which are set at a potential out of a range between the potentials of said first and said second power supply terminals.

4. A head driving device according to claim 3, wherein the semiconductor substrate serves as the back gates of said MOS transistors.

5. A head driving device for an ink-jet head including a plurality of ink chambers and electrostrictive members, each electrostrictive member including a first electrode and a second electrode, said first and second electrodes forming a capacitance and varies pressure in a corresponding ink chamber by electrostriction caused upon charging and discharging of the capacitance, the head driving device comprising:

a first power supply terminal and a second power supply terminal set at respective potentials different from each other; and a control circuit coupled to the first and second power supply terminals and to the first and second electrodes of each of the electrostrictive members for charging and discharging the capacitance of each of said electrostrictive members with use of the potentials of said first and said second power supply terminals; and wherein:

said control circuit includes an integrated circuit chip having a semiconductor substrate and plural pairs of a first switching element and a second switching element, said first and second switching elements being formed in said semiconductor substrate, the first electrode of each electrostrictive member is connected to the first and second power supply terminals respectively through the first and second switching elements of one pair of said plural pairs of switching elements, the second electrode of each electrostrictive member is connected to said first and second power supply terminals respectively through the first and second switching elements of another pair of said plural pairs of switching elements, and the second switching elements connected to the first and second electrodes of each electrostrictive member are formed of MOS transistors which are turned on upon application of a common gate potential to discharge the capacitance through source-drain paths thereof reversed from each other.

6. A head driving device according claim 5, wherein:

the potential of said first power supply terminal is higher than the potential of said second power supply terminal, and said integrated circuit chip is arranged such that the capacitance of each electrostrictive member is charged by turning on the first switching element connected to the first electrode of the respective capacitance and the second switching element connected to the second electrode of the respective capacitance and turning off the first switching element connected to the second electrode of the respective capacitance and the second switching element connected to the first electrode of the respective capacitance, and is discharged by turning on the second switching elements connected to the first and the second electrodes of the respective capacitance and turning off the first switching elements connected to the first and the second electrodes of the respective capacitance.

7. A head driving device for an ink-jet head including a plurality of ink chambers and electrostrictive members, each electrostrictive member including a first electrode and a second electrode, said first and second electrodes forming a capacitance and varies pressure in a corresponding ink chamber by electrostriction caused upon charging and discharging of the capacitance, the head driving device comprising;

a first power supply terminal and a second power supply terminal set at respective potentials different from each other; and a control circuit coupled to the first and second power supply terminals and to the first and second electrodes of each of the electrostrictive members for charging and discharging the capacitance of each of said electrostrictive members with use of the potentials of said first and said second power supply terminals; and wherein:

said control circuit includes an integrated circuit chip having a semiconductor substrate and plural pairs of a first switching element and a second switching element, said first and second switching elements being formed in said semiconductor substrate, the first electrode of each electrostrictive member is connected to the first and second power supply terminals respectively through the first and second switching elements of one pair of said plural pairs of switching elements, the second electrode of each electrostrictive member is connected to said first and second power supply terminals respectively through the first and second switching elements of another pair of said plural pairs of switching elements, and said control circuit further includes a plurality of third switching elements, each of said third switching elements being connected between the first and second electrodes of corresponding electrostrictive member and which are turned on to discharge the corresponding capacitance.

8. A head driving device according claim 7, wherein:

the potential of said first power supply terminal is higher than the potential of the second power supply terminal, and said integrated circuit chip is arranged such that the capacitance of each electrostrictive member is charged by turning on the first switching element connected to the first electrode of the respective capacitance and the second switching element connected to the second electrode of the respective capacitance and turning off the first switching element connected to the second electrode of the respective capacitance, the second switching element connected to the first electrode of the respective capacitance, and the third switching element connected between the first and second electrodes of the respective capacitance, and is discharged by turning on the second switching element connected to the second electrode of the respective capacitance and the third switching element connected between the first and second electrodes of the respective capacitance and turning off the first switching elements connected to the first and second electrodes of the respective capacitance, and the second switching element connected to the first electrode of the respective capacitance.

9. A head driving device according to claim 7, wherein the third switching elements are formed of MOS transfer gates.

* * * * *